US011265629B2

(12) United States Patent
Slotte

(10) Patent No.: US 11,265,629 B2
(45) Date of Patent: Mar. 1, 2022

(54) SPEAKER BOX

(71) Applicant: AAC Technologies Pte. Ltd., Singapore (SG)

(72) Inventor: Benedict Slotte, Turku (FI)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/893,374

(22) Filed: Jun. 4, 2020

(65) Prior Publication Data

US 2021/0385562 A1 Dec. 9, 2021

(51) Int. Cl.
*H04R 1/02* (2006.01)

(52) U.S. Cl.
CPC ..... *H04R 1/02* (2013.01)

(58) Field of Classification Search
CPC ..... H04R 1/02; H04R 1/025; H04R 1/2803; H04R 1/2819; H04R 1/288; H04R 1/2811; H04R 1/023; H04R 1/1008; H04R 1/2873; H04R 1/2888; H04R 1/021; H04R 1/08; H04R 1/1016; H04R 1/1066; H04R 1/10; H04R 1/83; H04R 1/22; H04R 1/283; H04R 1/2834; H04R 1/2842; H04R 1/2849; H04R 1/2857; H04R 1/345; H04R 2499/11; H04R 31/00; H04R 31/006; H04R 9/06; H04R 9/025; H04R 9/08; H04R 2400/11; H04R 2201/029; H04R 2307/025; H04R 3/002; H04R 9/25; H04R 2209/041; H04R 9/00; H04R 9/04; H04R 9/045; H04R 9/043; H04R 9/046; H04R 9/047; H04R 1/06
USPC ..... 381/177, 354, 357, 364, 370, 372, 71.6, 381/92
See application file for complete search history.

(56) References Cited

U.S. PATENT DOCUMENTS

2019/0014407 A1* 1/2019 Qin ..... H04R 1/2888
2019/0158951 A1* 5/2019 Cao ..... H04R 1/025

* cited by examiner

*Primary Examiner* — Fan S Tsang
*Assistant Examiner* — Julie X Dang
(74) *Attorney, Agent, or Firm* — W&G Law Group

(57) ABSTRACT

Provided is a speaker box, which includes a first damping member fixed to the housing and covering the sound outlet, and a second damping member fixed in the receiving space and fixed to the housing. The second damping member, the base and/or the cover define an extension cavity in communication with the front acoustic cavity. When the speaker produces sound, the extension cavity stabilizes frequency response variation caused by variation in the dynamic height of the air space. When the diaphragm of the speaker is at the lowest and highest positions of the air space, the variation in the final acoustic frequency response of the speaker box is always small, and the final acoustic frequency response of the speaker is also small. Thus, the intermodulation distortion of speakers in mobile devices or other thin devices can be reduced, and a sound quality of the speaker box can be improved.

8 Claims, 14 Drawing Sheets

SPEAKER BOX

TECHNICAL FIELD

The present disclosure relates to the field of acoustic technology, and particularly, to a speaker box.

BACKGROUND

Following the trend of ultra-thin mobile devices, a thickness of a mobile device is gradually decreased, and a thickness of an acoustic structure of an audio component such as a speaker in the mobile device is required to be reduced, accordingly. However, the thickness cannot be reduced to an arbitrary extent in order to maintain a good acoustic effect. The thickness of the acoustic structure itself is usually reduced by reducing a thickness of an air space above the speaker. In the speaker, it is necessary to provide a certain air space above a diaphragm for vibration and sound producing of the diaphragm. When the speaker produces sound, a dynamic height of the air space will vary greatly. When the diaphragm of the speaker is at the lowest position of the air space, the dynamic height of the air space will become greater; and when the diaphragm vibrates to reach the highest position of the air space, the dynamic height of the air space will become smaller, and a final acoustic frequency response of the speaker will also vary dynamically. That is, a sound filtering effect of the speaker has a dynamically varying cutoff frequency, which may lead to an intermodulation distortion. The intermodulation distortion is especially audible at higher frequencies or when playing back certain types of music (such as piano music).

Therefore, it is urgent to provide an improved speaker box to solve the above distortion problem.

SUMMARY

In view of the above, the present disclosure provides a speaker box, which solves the problems in the related art, i.e., the dynamically varying cutoff frequency of the sound filtering effect of the speakers may result in the intermodulation distortion, which is especially audible at higher frequencies or when playing back certain types of music (such as piano music).

A first aspect of the present disclosure provides a speaker box, including a housing having a receiving space, and a sound producing unit received in the receiving space and including a diaphragm. The housing includes a base supporting the sound producing unit, and a cover assembled with the base to define the receiving space together with the base. The cover and the diaphragm are opposite to each other and spaced apart from each other to form a front acoustic cavity. A sound outlet is provided in the cover by penetrating through the cover and communicates the front acoustic cavity with outside. The speaker box further includes a first damping member fixed to the housing and covering the sound outlet, and a second damping member fixed in the receiving space and fixed to the housing. The second damping member, the base and/or the cover define an extension cavity in communication with the front acoustic cavity.

In an embodiment of the present disclosure, the base includes a bottom wall opposite to the cover, and a side wall extending from an edge of the bottom wall towards the cover and reaching the cover.

In an embodiment of the present disclosure, the sound producing unit is fixed to the bottom wall, and the sound outlet is provided in the side wall by penetrating through the side wall.

In an embodiment of the present disclosure, at least one extension cavity is located at a side of the housing facing away from the sound outlet.

In an embodiment of the present disclosure, the extension cavity is filled with a sound absorbing material.

In an embodiment of the present disclosure, the sound absorbing material is integrally formed with the second damping member.

In an embodiment of the present disclosure, the second damping member is fixed by the cover and spaced apart from the bottom wall, and the extension cavity is defined by the second damping member and the cover.

In an embodiment of the present disclosure, the second damping member is fixed only by the base and spaced apart from the cover, and the extension cavity is defined by the second damping member and the base.

In an embodiment of the present disclosure, the second damping member is located at a side of the diaphragm facing away from the sound outlet and is opposite to and spaced apart from the side wall, the second damping member is fixedly sandwiched between the bottom wall and the cover, and the extension cavity is defined by the cover, the bottom wall, the second damping member, and the side wall.

In an embodiment of the present disclosure, the extension cavity includes a sound absorbing cavity close to the side wall and an auxiliary cavity located between the sound absorbing cavity and the second damping member, and the auxiliary cavity is in communication with the sound absorbing cavity and has a smaller volume than the sound absorbing cavity.

In an embodiment of the present disclosure, the sound absorbing cavity is filled with a sound absorbing material, and the auxiliary cavity is filled with air.

The speaker box according to the embodiments of the present disclosure includes the first damping member fixed to the housing and covering the sound outlet, and the second damping member fixed in the receiving space and fixed to the housing, and the second damping member, the base and/or the cover define an extension cavity in communication with the front acoustic cavity. When the speaker produces sound, the extension cavity stabilizes a variation in the dynamic frequency response of the speaker. When the diaphragm of the speaker is at the lowest and highest positions of the air space, the final acoustic frequency response of the speaker is also stabilized. Thus, the intermodulation distortion of speakers in mobile devices or other thin devices can be reduced, and a sound quality of the speaker box can be improved.

BRIEF DESCRIPTION OF DRAWINGS

In order to clarify the technical solutions of the embodiments of the present disclosure, the technical solutions in the embodiments of the present disclosure are described below with reference to the accompanying drawings. It should be understood that the following drawings merely illustrate some embodiments of the present application, and those skilled in the art may obtain other embodiments without creative efforts according to the accompanying drawings of the present disclosure.

DESCRIPTION OF EMBODIMENTS

Figure 1:
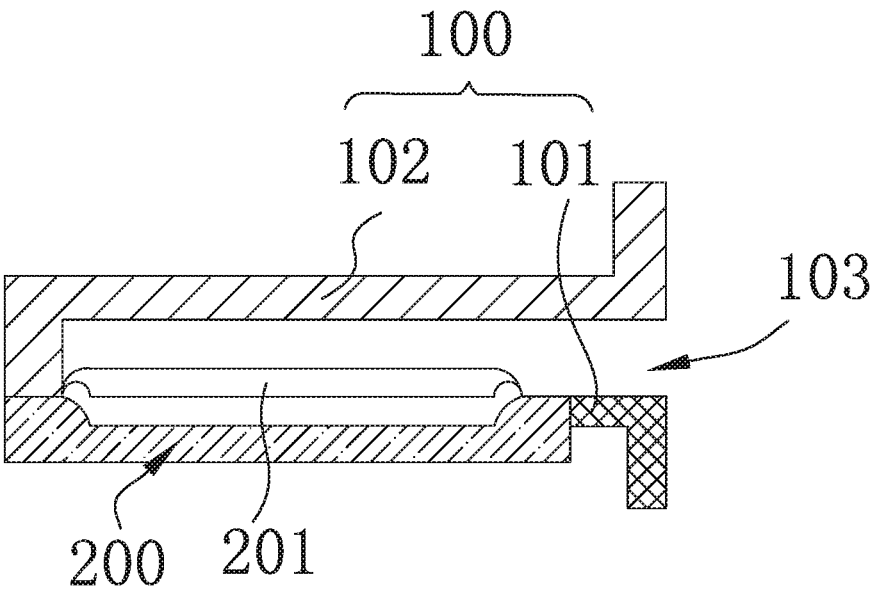
FIG. 1 (Related Art)
FIG. 1 is a structural schematic diagram of a speaker box known in the related art.

FIG. 1 is a structural schematic diagram of a speaker box known in the related art. As shown in FIG. 1, a speaker known in the related art includes a housing 100 having a receiving space, and a sound producing unit 200 received in the receiving space and including a diaphragm 201. The housing 100 includes a base 101 supporting the sound producing unit 200, and a cover 102 defining the receiving space together with the base 101. The cover 102 and the diaphragm 201 are opposite to each other and spaced apart from each other to form the front acoustic cavity. A sound outlet 103 is provided in the cover 102 by penetrating through the cover 102, and communicates the front acoustic cavity with outside. The sound generated by the sound producing unit 200 is emitted to the air outside the speaker box through the sound outlet 103, i.e., to the ambient air outside an electronic device.

As described above, the thickness of the mobile devices is gradually decreased, and the thickness of the acoustic structure of an audio component such as speaker in the mobile device is required to be reduced accordingly. However, the thickness cannot be reduced to an arbitrary extent in order to maintain a good sound effect. The thickness of the speaker box itself is usually reduced by reducing the thickness of the air space above the sound producing unit. In the speaker box, it is necessary to provide a certain air space above a diaphragm for vibration and sound producing of the diaphragm. When the speaker produces sound, the dynamic height of the air space will vary greatly. When the diaphragm of the speaker is at the lowest position of the air space, the dynamic height of the air space will become greater; and when the diaphragm vibrates to reach the highest position of the air space, the dynamic height of the air space will become smaller, and a final acoustic frequency response of the speaker will also vary dynamically. A frequency response simulation test was performed on the speaker box known in the related art, i.e., the speaker box shown in FIG. 1.

Figure 2:
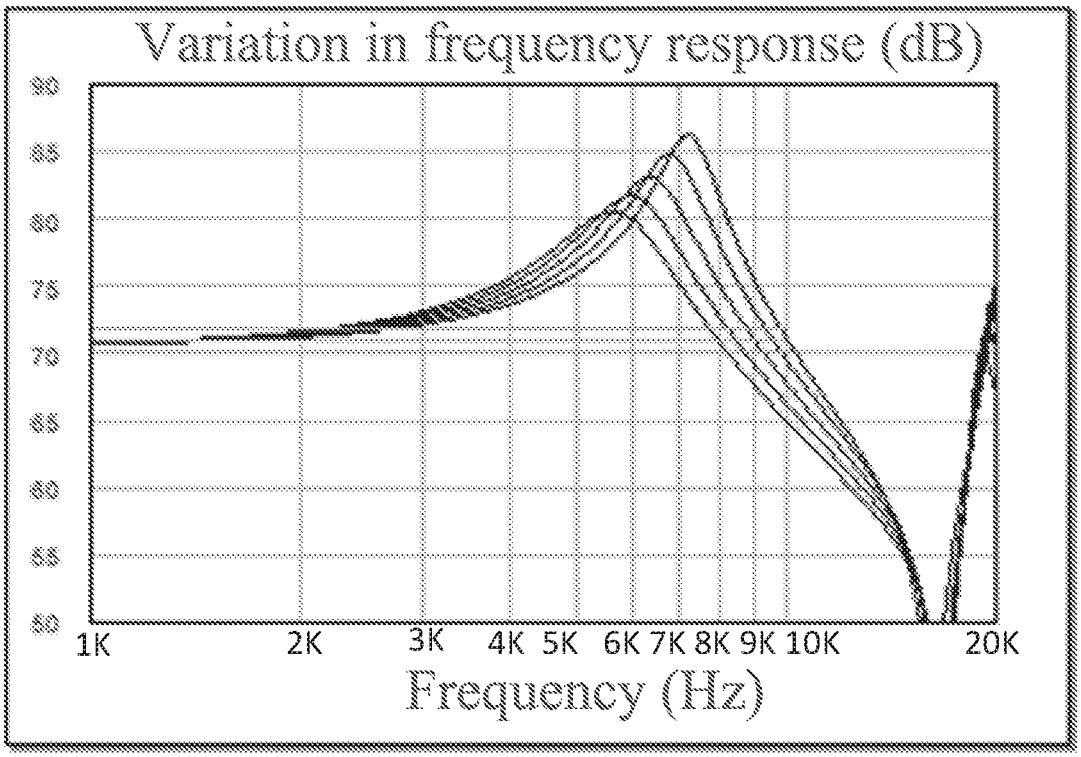
FIG. 2 (Related Art)
FIG. 2 is graph of a frequency response simulation test of a speaker box known in the related art.

For example, in the speaker box shown in FIG. 1, a space between the diaphragm and the cover 102 has a height of 1 mm, a length (along a sound propagation direction) of 12 mm, and a width of 14 mm. Most of a vibration cavity is located above the diaphragm of the speaker 100, meaning that the dynamic height of most of the vibration cavity will vary with a displacement of the diaphragm. In this case, the diaphragm is assumed to have an amplitude of 0.6 mm. In this regard, the dynamic height between the diaphragm and the cover 102 may vary from 0.4 mm (i.e., the maximum displacement of the diaphragm vibrating in a direction facing towards the upper cover) to 1.6 mm (i.e., the maximum displacement of the diaphragm vibrating in a direction facing away from the upper cover). FIG. 2 illustrate a graph of the frequency response simulation test on the speaker box shown in FIG. 1. The five curves in FIG. 2 refer to t five different positions of the vibrating diaphragm: maximum displacement in one direction, half of maximum displacement in one direction, no displacement (i.e. resting position), half of maximum displacement in another direction, and maximum displacement in another direction. As shown in FIG. 2, a variation of a frequency response of the speaker box may reach up to 12 dB at a frequency between 7 KHZ to 8 KHZ, and the variation in the frequency response exceeds 5 dB at any frequency between 6 KHZ to 12 KHZ. The acoustic frequency response of the speaker box has a poor stability, i.e., the acoustic frequency response has a great dynamical variation especially when the frequency is below 10 KHZ. In other words, the sound filtering effect of the speaker box has a dynamically varying cut-off frequency, which may result in the intermodulation distortion, which is especially audible at higher frequencies or when playing back certain types of music (such as piano music).

In order to solve the problem of the speaker box in the related art, in which the speaker box is unable to be adapted to ultra-thin or thin electronic devices due to the intermodulation distortion caused by the reduced thickness, embodiments of the present disclosure provide a speaker box. The speaker box includes a first damping member fixed to a housing and covering a sound outlet, and a second damping member fixed in a receiving space and fixed to the housing. The second damping member, a base and/or a cover define an extension cavity in communication with a front acoustic cavity. When the speaker produces sound, the extension cavity can stabilize frequency response variation caused by the variation of the dynamic height of the air space. That is, when the diaphragm of the speaker is at the lowest position of the air space as well as when the diaphragm of the speaker is at the highest position of the air space, the final acoustic frequency response of the speaker box is stable, thereby reducing the intermodulation distortion. In this way, the intermodulation distortion of speakers in mobile devices or other thin devices can be reduced, and in the meantime, an available sound quality of the speaker box can be improved.

For better illustrating technical solutions of the present disclosure, the embodiments of the present disclosure will be described in detail as follows with reference to the accompanying drawings.

It should be noted that, the described embodiments are merely illustrative, and shall not be interpreted as limitations to the present disclosure. On basis of the embodiments of the present disclosure, other embodiments obtained by those skilled in the art without paying creative efforts shall fall within the protection scope of the present disclosure.

The terms used in the embodiments of the present disclosure are merely or the purpose of describing the specific embodiments, instead of limiting the present disclosure. Unless otherwise noted in the context, the singular form expressions "a", "an", "the" and "said" used in the embodiments and appended claims of the present disclosure are also intended to represent plural form expressions thereof.

It should be understood that the term "and/or" used herein is merely an association relationship describing associated objects, indicating that there may be three relationships. For example, A and/or B may indicate three cases, i.e., A existing individually, A and B existing simultaneously, B existing individually. In addition, the character "/" herein generally indicates that the related objects have an "or" relationship.

Figure 3:
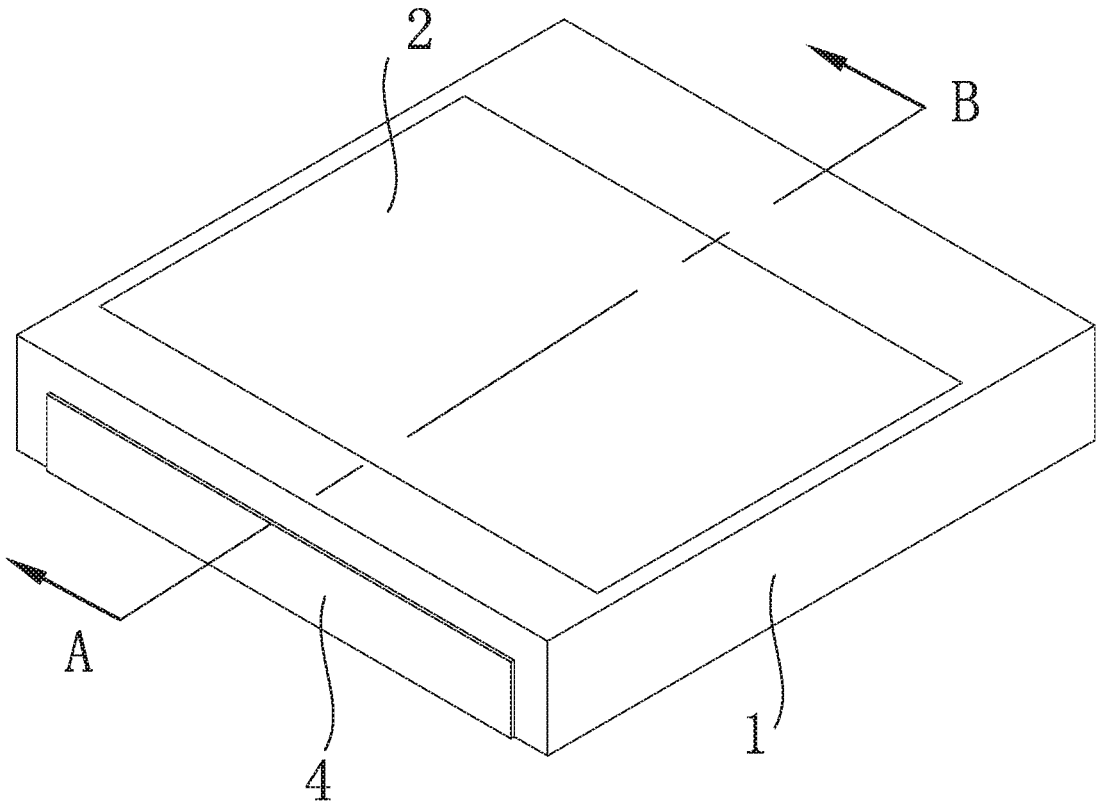
FIG. 3 is a structural perspective view of a speaker box according to an embodiment of the present disclosure.
Figure 4:
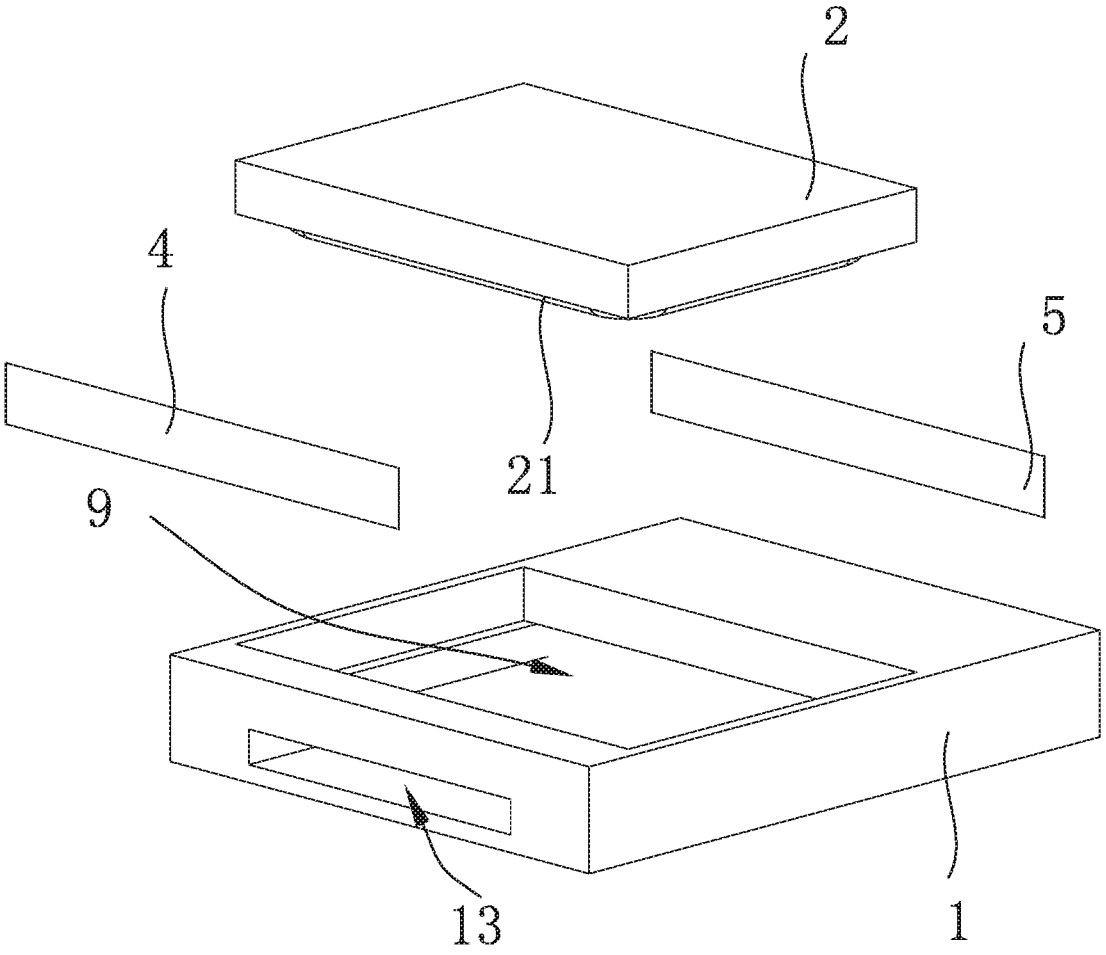
FIG. 4 is a structural exploded view of the speaker box in FIG. 3.
Figure 5:
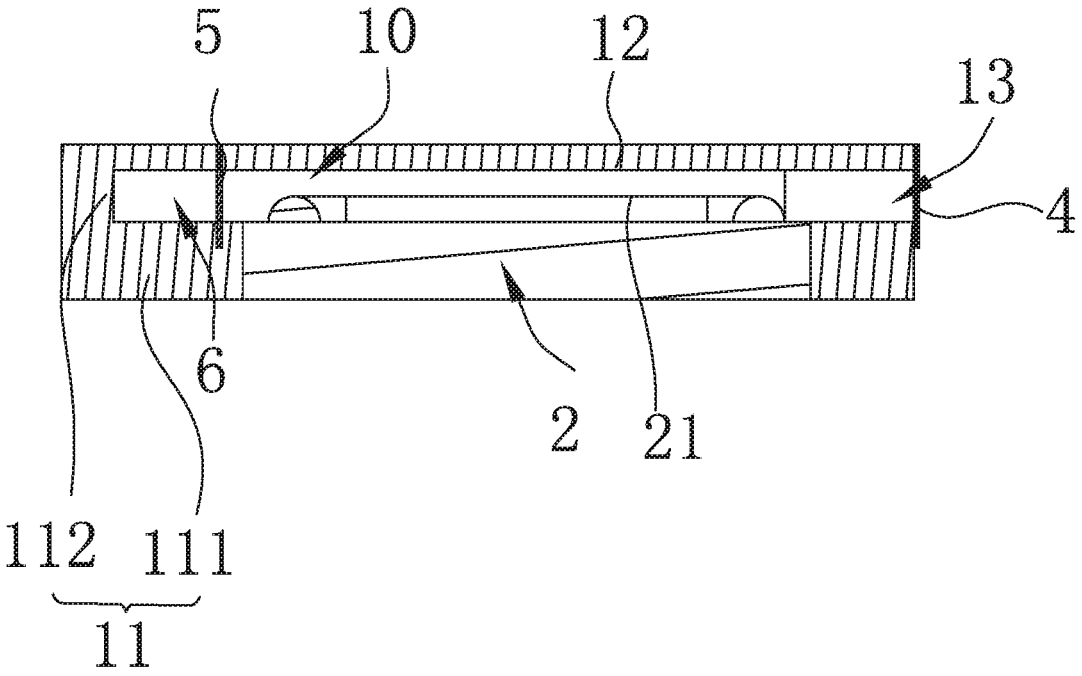
FIG. 5 is a cross-sectional view of the speaker box along line A-B in FIG. 3.

FIG. 3 is a perspective view of a speaker box according to an embodiment of the present disclosure, FIG. 4 is a structural exploded view of the speaker box in FIG. 3, and FIG. 5 is a cross-sectional view of the speaker box along line A-B in FIG. 3. As shown in FIGS. 3 to 5, the speaker box includes a housing 1 having a receiving space 9, and a sound producing unit 2 received in the receiving space 9 and including a diaphragm 21. The housing 1 includes a base 11 supporting the sound producing unit 2, and a cover 12 defining the receiving space together with the base 11. The cover 12 and the diaphragm 21 are opposite to each other and spaced apart from each other to form a front acoustic cavity 10. A sound outlet 13 is provided in the cover 12 by penetrating through the cover 12, and communicates the front acoustic cavity 10 with outside. The speaker box further includes a first damping member 4 fixed to the housing 11 and covering the sound outlet 13, and a second damping member 5 fixed in the receiving space 9 and fixed to the housing 1. The second damping member 5, the base 11 and/or the cover 12 define an extension cavity 6 in communication with the front acoustic cavity 10.

In an example, the housing 1 can be formed integrally (as illustrated in FIGS. 3 to 5), or can be formed by splicing the base 11 and the cover 12 as illustrated in FIG. 6 to FIG. 8, FIG. 10, and FIG. 12 to FIG. 14. Compared with FIG. 3-4, the speaker box in FIG. 5 is positioned upside down to get the cover on the top so as to clearly explain the structure of the speaker box, just like FIGS. 6-8, 10, and 12-14.

The cover 12 and the diaphragm 21 are opposite to each other and spaced apart from each other to form the front acoustic cavity 10, the speaker box includes the second damping member 5 fixed in the receiving space 9 and fixed to the housing 1, and the second damping member 5, the base 11 and/or the cover 12 define the extension cavity 6 in communication with the front acoustic cavity 10. A ratio between an amplitude of the diaphragm 21 and a distance from the upper cover 12 to the diaphragm 21 is more than 10%. For example, the amplitude is 0.65 mm, while the height of the front acoustic cavity 10, i.e., the distance from the upper cover 12 to the diaphragm 21, is 1.3 mm, and the ratio in this case would be 50%. Typically, to obtain a better acoustic performance, the ratio is less than 70%. Thus, when the speaker produces sound, the extension cavity 6 can stabilize frequency response variation caused by the variation of the dynamic height of the air space. That is, when the diaphragm of the speaker is at the lowest position of the air space as well as when the diaphragm of the speaker is at the highest position of the air space, the final acoustic frequency response of the speaker box changes less, thereby reducing the intermodulation distortion. In this way, the intermodulation distortion of speakers in mobile devices or other thin devices can be reduced, and in the meantime, a sound quality of the speaker box can be improved.

In an example, as shown in FIG. 5, the base 11 includes a bottom wall 111 opposite to the cover 12, and a side wall 112 extending from an edge of the bottom wall 111 while being bent towards the cover 12 and reaching the cover 12.

In an example, the sound producing unit 2 is fixed to the bottom wall 111, the sound outlet 13 is provided in the side wall 112 by penetrating through the side wall 112.

In an example, as shown in FIG. 5 through FIG. 8, FIG. 10, and FIG. 12 through FIG. 14, at least one extension cavity 6 is located at a side of the housing 1 facing away from the sound outlet 13.

Figure 7:
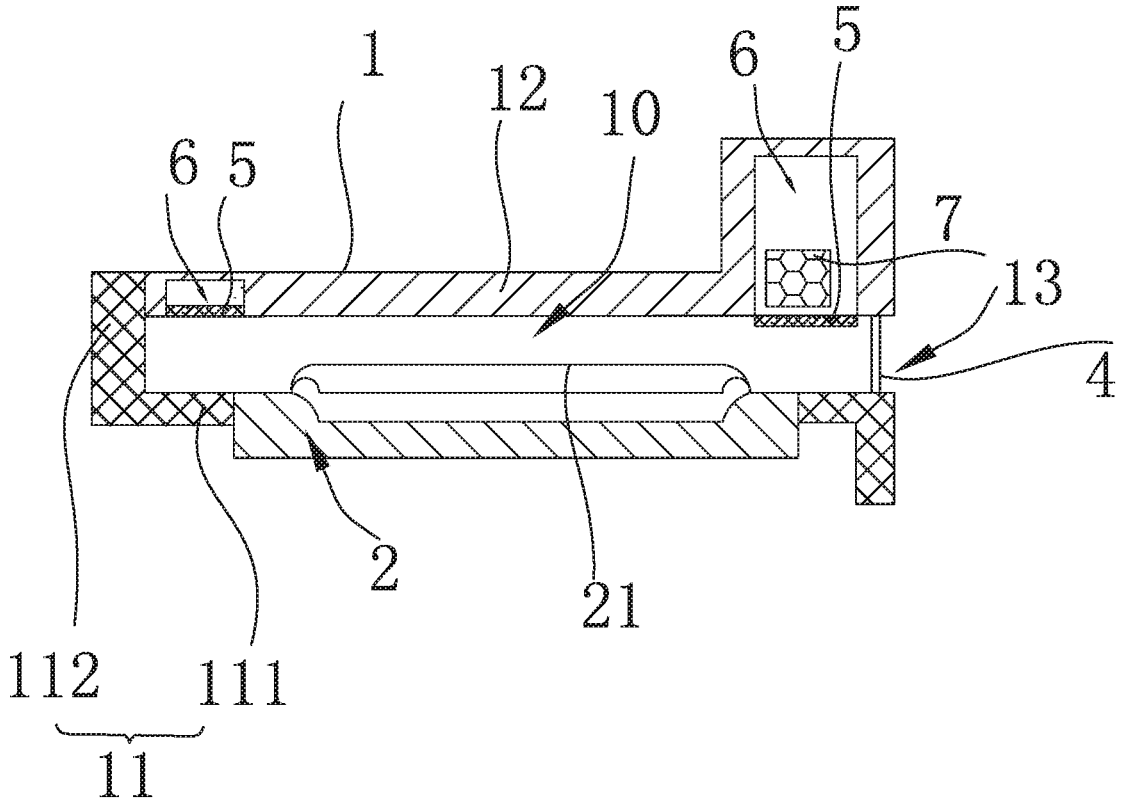
FIG. 7 is a cross-sectional view of a speaker box, along the same line A-B as shown in FIG. 3, according to yet another embodiment of the present disclosure.

In an example, the extension cavity 6 is filled with a sound absorbing material 7, as shown in FIG. 7, and the sound absorbing material 7 can increase an apparent volume of the extension cavity 6. In this way, the extension cavity 6 has a relatively small physical size, which allows the acoustic frequency response of the speaker box according to the embodiments of the present disclosure has a good stability and a good acoustic damping effect at the frequency lower or higher than 10 HKZ.

In an example, the second damping member 5 can be made of a same material as the sound absorbing material 7. In this case, the second damping member 5 is integrally formed with the sound absorbing material 7, i.e., the second damping member 5 can serve as a damping member as well as a filler with which the extension cavity 6 is filled, which improves the damping effect of the speaker box while simplifying the manufacturing process of the speaker box.

Figure 6:
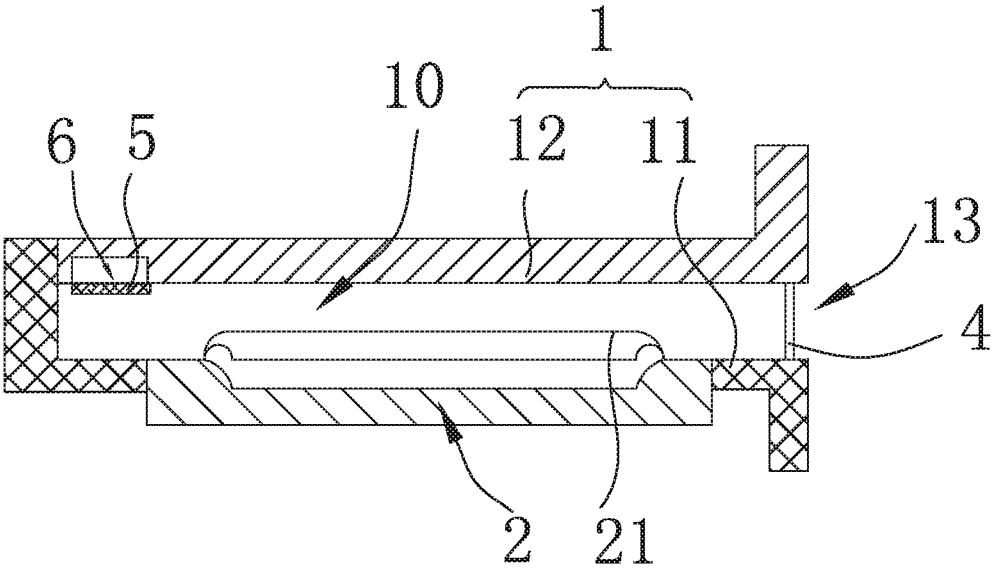
FIG. 6 is a cross-sectional view of a speaker box, along the same line A-B as shown in FIG. 3, according to another embodiment of the present disclosure.

In another embodiment of the present disclosure, as shown in FIG. 6 and FIG. 7, the second damping member 5 is fixed by the cover 12, the second damping member 5 is spaced apart from the bottom wall 111, and the extension cavity 6 is defined by the second damping member 5 and the cover 12.

It should be understood that the second damping member 5 can be fixed at a position on the cover 12 close to the sound outlet 13, as shown in FIG. 7; or it can also be fixed at a position on the cover 12 facing away from the sound outlet 13, as shown in FIG. 6. That is, the second damping member 5 may be fixed on either one side or both sides of the cover 12 along a vibration direction of the diaphragm 21.

Figure 8:
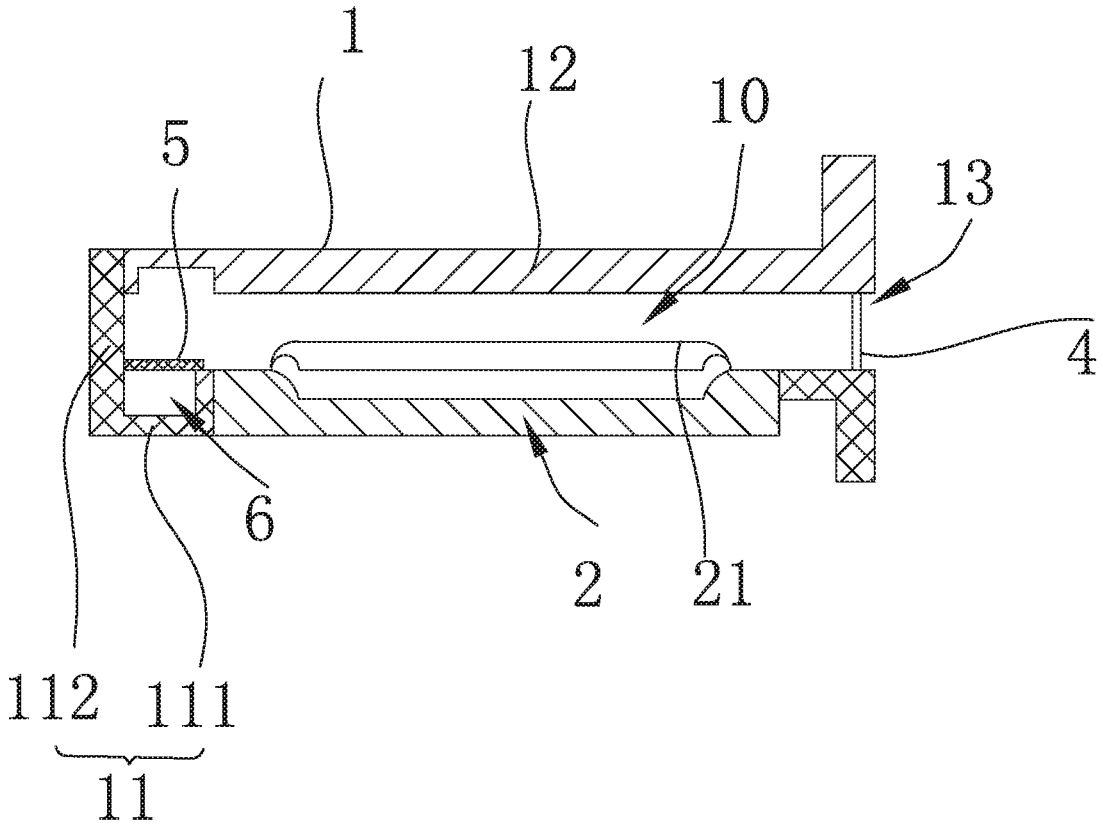
FIG. 8 is a cross-sectional view of a speaker box, along the same line A-B as shown in FIG. 3, according to yet another embodiment of the present disclosure.

In another embodiment of the present disclosure, as shown in FIG. 8, the second damping member 5 is fixed only by the base 11 and spaced apart from the cover 12, and the extension cavity 6 is defined by the second damping member 5 and the base 11.

In an example, the second damping member 5 may be fixed on the side wall 112, as shown in FIG. 8, and the extension cavity 6 is formed by the second damping member 5 and the bottom wall 111 of the base 11.

In another embodiment of the present disclosure, as shown in FIG. 5, the second damping member 5 is located at a side of the diaphragm 21 facing away from the sound outlet 13 and is opposite to and spaced apart from the side wall 112, the second damping member 5 is fixedly sandwiched between the bottom wall 111 and the cover 12, and the extension cavity 6 is defined by the cover 12, the bottom wall 111, the second damping member 5, and the side wall 112.

Figure 9:
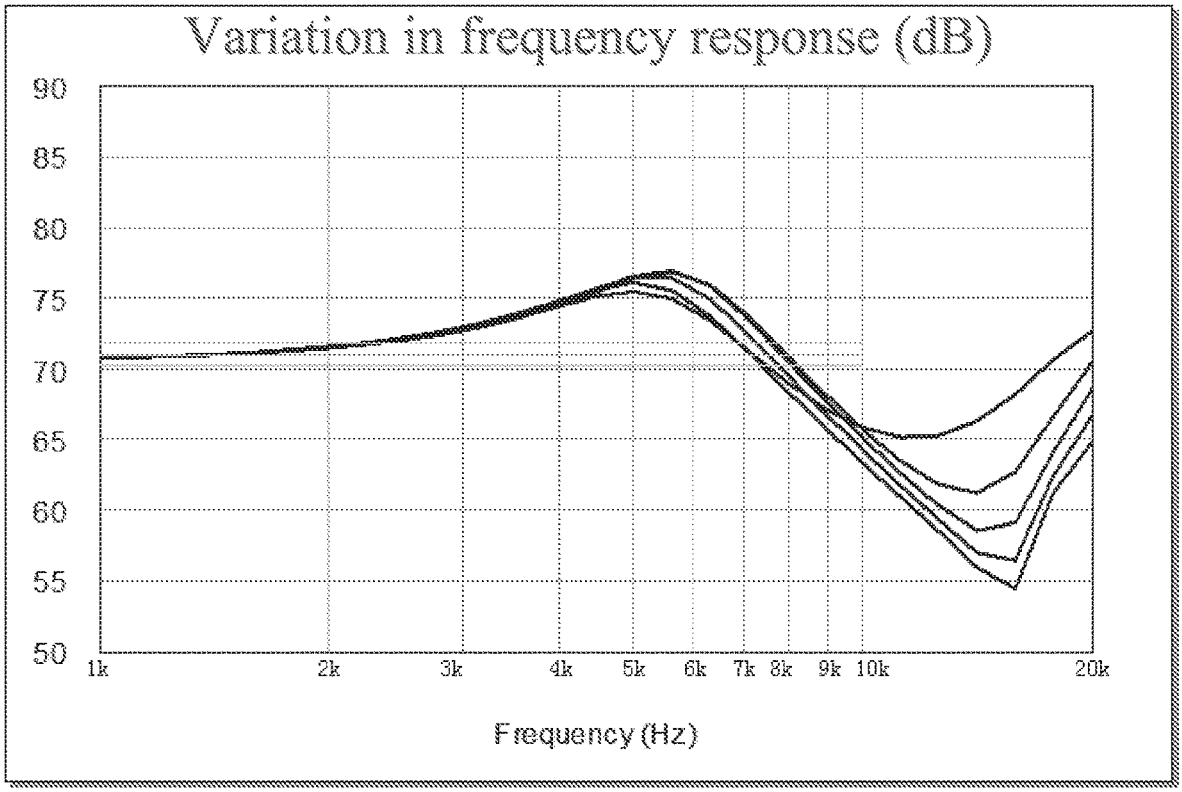
FIG. 9 is graph of a frequency response simulation test of the speaker box shown in FIG. 5.

In order to verify that the acoustic frequency response of the speaker box according to the embodiment of the present disclosure has a good stability, the speaker box shown in FIG. 5 was subjected to a frequency response simulation test. The parameters of the speaker box are as follows: the extension cavity 6 has a height of 1 mm, a width of 14 mm, and a length (along the sound propagation direction) of 2.1 mm; the first damping member 4 has an acoustic resistance of 110 kPas/m; and the second damping member 5 has an acoustic resistance of 7 kPas/m. The graph of the frequency response simulation test is illustrated in FIG. 9. The same as FIG. 2, the curves in FIG. 9 also represent different position of the diaphragm. As shown in FIG. 9, compared with the speaker box in the related art, the speaker box according to the embodiments of the present disclosure has a good stability of the acoustic frequency response when the frequency is lower than 10 KHZ, and the stability of the acoustic frequency response of the speaker box is also relatively high when the frequency is higher than 10 HKZ.

In an example, as shown in FIG. 5, the extension cavity 6 is in communication with the front acoustic cavity 10, and no sound absorbing material is filled in the extension cavity 6. In the embodiment of the present disclosure, although the extension cavity 6 allows the acoustic frequency response of the speaker box to be stable and reduces the probability of the intermodulation distortion, the sensitivity of the entire speaker box is reduced as the extension cavity 6 is merely filled with air instead of the sound absorbing material.

Figure 10:
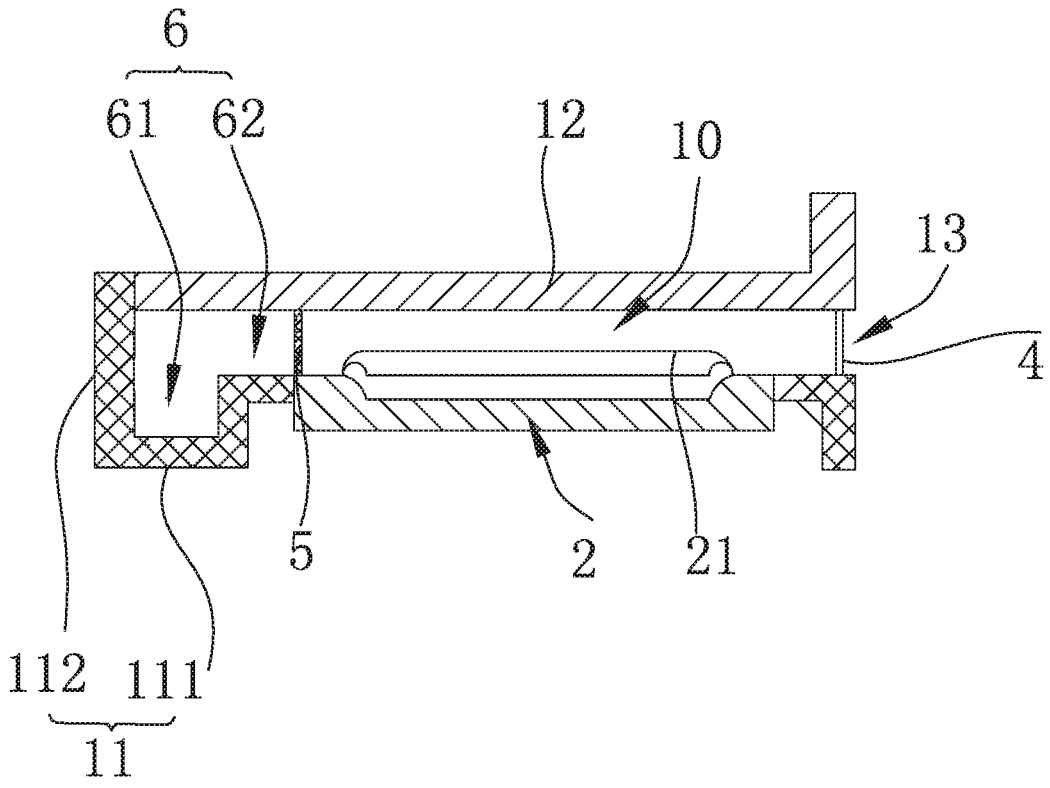
FIG. 10 is a cross-sectional view of a speaker box, along the same line A-B as shown in FIG. 3, according to yet another embodiment of the present disclosure.

In an example, as shown in FIG. 10, the extension cavity 6 includes a sound absorbing cavity 61 close to the side wall 112 and an auxiliary cavity 62 located between the sound absorbing cavity 61 and the second damping member 5. The auxiliary cavity 62 is in communication with the sound absorbing cavity 61 and has a smaller volume than the sound absorbing cavity 61.

Figure 11:
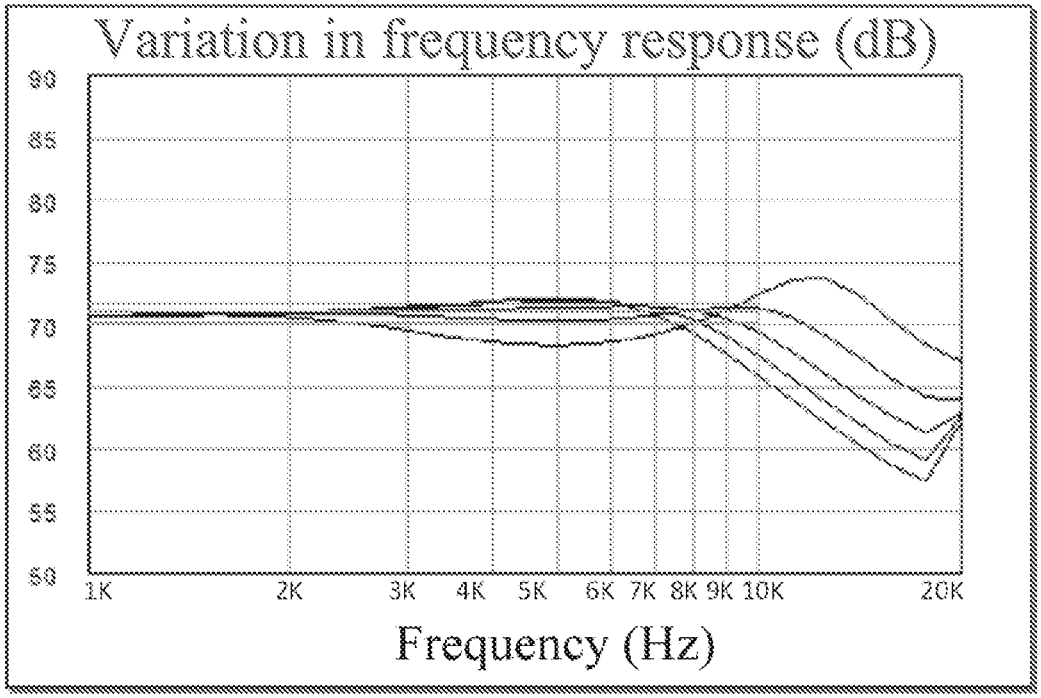
FIG. 11 is graph of a frequency response simulation test of the speaker box shown in FIG. 10.

In order to verify that the acoustic frequency response of the speaker box according to the embodiment of the present disclosure has a good stability, the speaker box shown in FIG. 10 was subjected to a frequency response simulation test. The parameters of the speaker box are as follows: the extension cavity 6 has a volume of 190 $mm^3$, a sectional area of 4.5 $mm^2$, and a length (along the sound propagation direction) of 2 mm; the first damping member 4 has an acoustic resistance of 55 kPas/m; and the second damping member 5 has an acoustic resistance of 7 kPas/m. The graph of the frequency response simulation test is illustrated in FIG. 11. As shown in FIG. 11, the variation in the frequency response is not greater than 4 dB in any important frequency range. Compared with the speaker box in the related art, the speaker box according to the embodiment of the present disclosure has a good stability of the acoustic frequency response.

Figure 12:
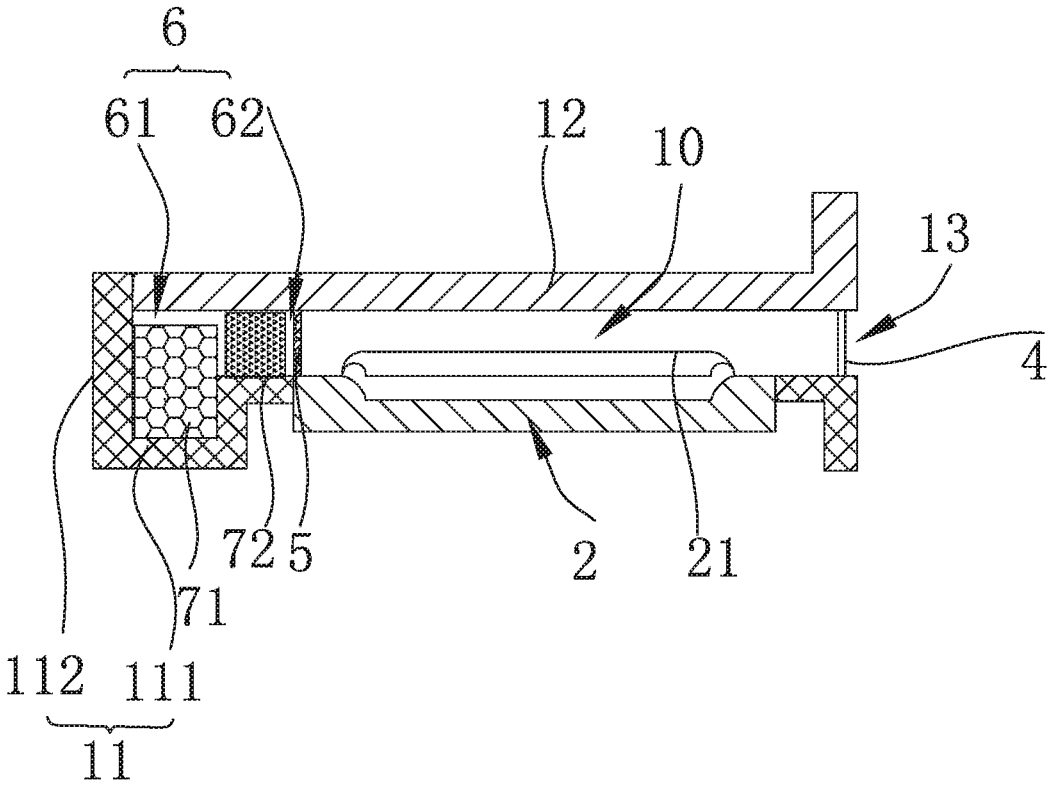
FIG. 12 is a cross-sectional view of a speaker box, along the same line A-B as shown in FIG. 3, according to yet another embodiment of the present disclosure.

In an example, the sound absorbing cavity 61 is filled with a first filler 71, as shown in FIG. 12. The first filler 71 can increase an apparent volume of the sound absorbing cavity 61, so that the sound absorbing cavity 61 has a relatively small physical size. In this way, the speaker box according to the embodiment of the present disclosure is further allowed to have a good stability in the acoustic frequency response of the speaker box.

In an example, the first filler 71 includes a sound absorbing material.

Likewise, the auxiliary cavity 62 is filled with a second filler 72, as shown in FIG. 12. The second filler 72 can increase an apparent volume of the auxiliary cavity 62, so that the auxiliary cavity 62 has a relatively small physical size. In this way, the speaker box according to the embodiment of the present disclosure is further allowed to have a good stability in the acoustic frequency response of the speaker box no matter the frequency is lower than 10 KHZ or higher than 10 HKZ.

In an example, the second filler 72 is air.

In an example, the first filler 71 can be a material capable of generating damping, such that the speaker box has a good acoustic damping effect.

The second filler 72 can be a material capable of generating damping, such that the speaker box has a good acoustic damping effect.

It should be understood that the second filler 71 may be a material capable of generating damping, or may be a material capable of increasing the apparent volume of the auxiliary cavity 62, or may be a mixture of the material capable of generating damping and the material capable of increasing the apparent volume of the auxiliary cavity 62.

It should also be understood that the material of the first filler 71 and the material of the second filler 72 may be the same or different, as long as the material of the first filler 72 can increase the apparent volume of the sound absorbing cavity 61 or generate damping and the material of the second filler 72 can increase the apparent volume of the auxiliary cavity 62 or generate damping. The embodiments of the present disclosure do not limit whether the material of the first filler 71 and the material of the second filler 72 are the same or not.

Figure 13:
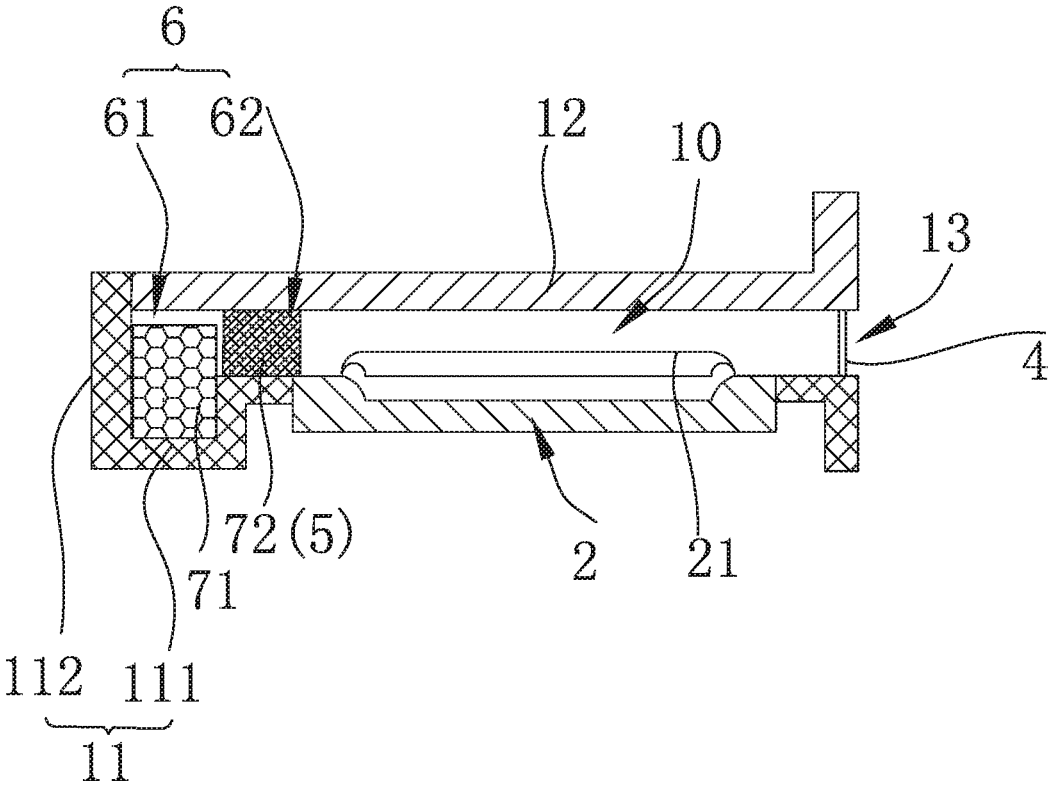
FIG. 13 is a cross-sectional view of a speaker box, along the same line A-B as shown in FIG. 3, according to yet another embodiment of the present disclosure.

In another embodiment of the present disclosure, when the material of the first filler 71 and the material of the second filler 72 are each a material capable of generating damping, the second filler 72 and the second damping member 5 can be formed into one piece, as shown in FIG. 13, thereby simplifying the manufacturing process of the speaker box.

Figure 14:
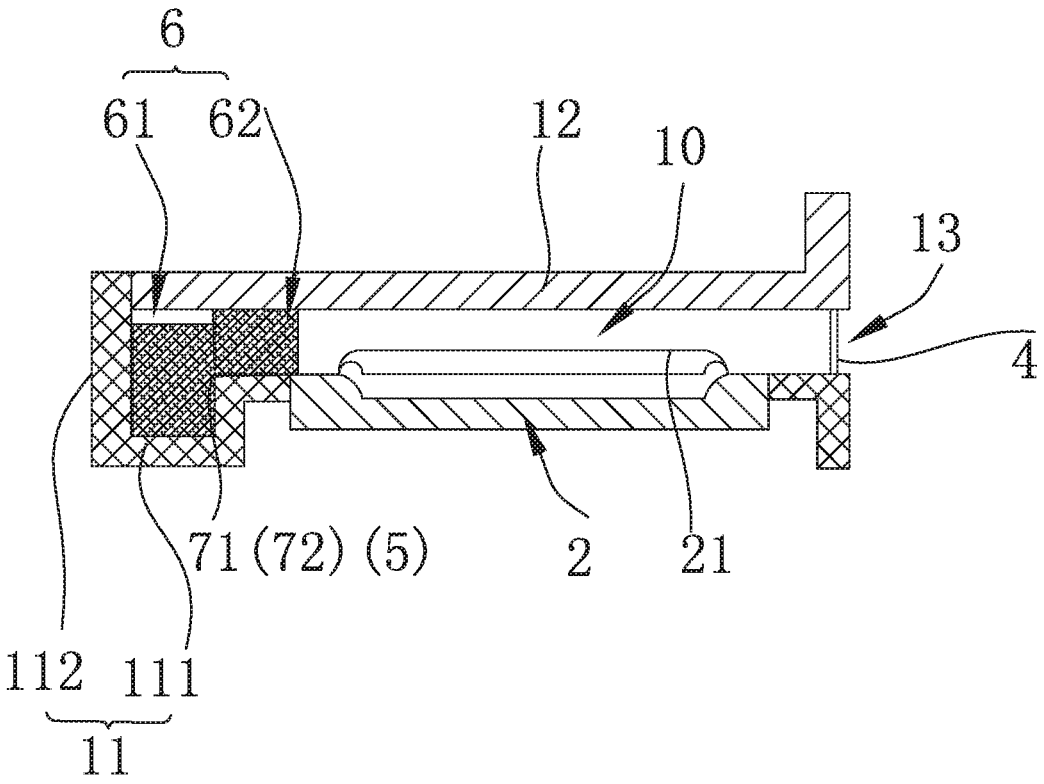
FIG. 14 is a cross-sectional view of a speaker box, along the same line A-B as shown in FIG. 3, according to yet another embodiment of the present disclosure.

In another embodiment of the present disclosure, as shown in FIG. 14, the first filler 71, the second filler 72 and the second damping member 5 are formed into one piece, so as to increase the sound damping effect of the speaker box while further simplifying the manufacturing process of the speaker box.

It should be understood that the first filler 71, the second filler 72 and the second damping member 5 can be formed into one piece not only when both the first filler 71 and the second filler 72 are made of the material capable of generating damping. When the first filler 71 and the second filler 72 are both the sound absorbing materials and the second damping member 5 is made of the same material as the first filler 71 and the second filler 72, the first filler 71, the second filler 72 and the second damping member 5 can also be formed into one piece.

The above-described embodiments are merely preferred embodiments of the present disclosure, but are not intended to limit the present disclosure. Any modifications, equivalent substitutions and improvements made within the principle of the present disclosure shall fall within the protection scope of the present disclosure.

What is claimed is:

1. A speaker box, comprising:

a housing having a receiving space;

a sound producing unit received in the receiving space and comprising a diaphragm, wherein the housing comprises a base supporting the sound producing unit, and a cover assembled with the base to define the receiving space together with the base, the cover and the sound producing unit are spaced apart from each other to form a front acoustic cavity, and a sound outlet is provided in the cover by penetrating through the cover and communicates the front acoustic cavity with outside;

a first damping member fixed to the housing and covering the sound outlet; and a second damping member fixed in the receiving space and fixed to the housing, wherein the second damping member, the base and/or the cover define an extension cavity in communication with the front acoustic cavity;

the base comprises a bottom wall opposite to the cover, and a side wall extending from an edge of the bottom wall while being bent towards the cover and reaching the cover; the extension cavity comprises a sound absorbing cavity close to the side wall and an auxiliary cavity located between the sound absorbing cavity and the second damping member, and the auxiliary cavity is in communication with the sound absorbing cavity.

2. The speaker box as described in claim 1, wherein, the diaphragm is opposite to the cover, and spaced apart from the cover to form the front acoustic cavity.

3. The speaker box as described in claim 1, wherein the sound producing unit is fixed to the bottom wall, and the sound outlet is provided in the side wall by penetrating through the side wall.

4. The speaker box as described in claim 3, wherein the sound absorbing material is integrally formed with the second damping member.

5. The speaker box as described in claim 1, wherein the second damping member is located at a side of the diaphragm facing away from the sound outlet and is opposite to and spaced apart from the side wall, the second damping member is fixedly sandwiched between the bottom wall and the cover, and the extension cavity is defined by the cover, the bottom wall, the second damping member, and the side wall.

6. The speaker box as described in claim 1, wherein the auxiliary cavity has a smaller volume than the sound absorbing cavity.

7. The speaker box as described in claim 6, wherein the sound absorbing cavity is filled with a sound absorbing material, and the auxiliary cavity is filled with air.

8. The speaker box as described in claim 1, wherein a ratio between an amplitude of the diaphragm and a distance from the upper cover to the diaphragm is more than 10%.

* * * * *